US011918840B2

(12) United States Patent
Jones

(10) Patent No.: US 11,918,840 B2
(45) **Date of Patent: *Mar. 5, 2024**

(54) FITNESS BAR WITH MOTION INTERNAL WEIGHTS

(71) Applicant: Zacerous Jones, Los Angeles, CA (US)

(72) Inventor: Zacerous Jones, Los Angeles, CA (US)

( * ) Notice: Subject to any disclaimer, the term of this patent is extended or adjusted under 35 U.S.C. 154(b) by 277 days.

This patent is subject to a terminal disclaimer.

(21) Appl. No.: 17/228,050

(22) Filed: Apr. 12, 2021

(65) Prior Publication Data

US 2021/0228932 A1 Jul. 29, 2021

Related U.S. Application Data

(63) Continuation of application No. 16/028,686, filed on Jul. 6, 2018, now Pat. No. 10,974,090.

(51) Int. Cl.
*A63B 21/06* (2006.01)
*A63B 21/072* (2006.01)

(52) U.S. Cl.
CPC ..... *A63B 21/0603* (2013.01); *A63B 21/072* (2013.01)

(58) Field of Classification Search
CPC ..... A63B 21/06–0603; A63B 21/072–075; A63B 21/0004; A63B 21/00058–00065; A63B 21/0608; A63B 21/002; A63B 22/0002; A63B 71/0036; A63B 71/0054; A63B 2071/0694; A63B 2209/00; A63B 19/00–02; A63B 33/02
See application file for complete search history.

(56) References Cited

U.S. PATENT DOCUMENTS

| | | | | |
|---|---|---|---|---|
| 2,209,465 | A | 7/1940 | Anthony | |
| 3,881,277 | A * | 5/1975 | Delph | A63H 33/02 446/450 |
| 4,501,934 | A | 2/1985 | Wiener | |
| 4,743,016 | A | 5/1988 | Van Derworp et al. | |
| 5,044,250 | A | 9/1991 | Beyer | |
| 5,056,778 | A * | 10/1991 | Hull | A63B 21/0602 482/93 |
| 5,244,445 | A | 9/1993 | Amesquita | |
| 5,599,333 | A | 2/1997 | Atkinson | |
| 5,820,531 | A | 10/1998 | Choi | |
| 5,823,846 | A * | 10/1998 | Arriola | A63B 19/00 446/236 |
| 6,450,854 | B1 * | 9/2002 | Fireman | A63B 21/0602 446/28 |
| 7,749,145 | B2 | 7/2010 | Allen et al. | |
| D633,155 | S | 2/2011 | Brun | |
| 8,888,665 | B2 | 11/2014 | Pfitzer | |
| 9,044,642 | B2 * | 6/2015 | Mikulski | A63B 21/075 |
| 10,974,090 | B1 * | 4/2021 | Jones | A63B 22/0002 |
| 2008/0153676 | A1 * | 6/2008 | Krietzman | A63B 19/00 482/93 |

(Continued)

*Primary Examiner* — Loan B Jimenez
*Assistant Examiner* — Kathleen M Fisk

(57) ABSTRACT

A fitness bar that houses free-moving weights and a flow impeder. The speed and the movement of the weights are controlled by the flow impeder and the angle of which the bar is positioned. The outer layer of the tube is covered with a material that improves the grip of the fitness bar. When performing exercises with the fitness bar, you will develop a more defined, flexible and stronger body.

20 Claims, 3 Drawing Sheets

(56) References Cited

U.S. PATENT DOCUMENTS

| | | | | |
|---|---|---|---|---|
| 2013/0196830 | A1* | 8/2013 | Pfitzer | A63B 21/0618<br>482/110 |
| 2015/0251043 | A1 | 9/2015 | Holderbaum | |
| 2017/0001060 | A1* | 1/2017 | D'Alesio | A63B 21/0602 |
| 2019/0247704 | A1* | 8/2019 | Mikulski | A63B 21/4035 |

* cited by examiner

Side View

Plan View

FITNESS BAR WITH MOTION INTERNAL WEIGHTS

CROSS-REFERENCE TO RELATED APPLICATIONS

This patent application is a continuation of U.S. patent application Ser. No. 16/028,686, filed Jul. 6, 2018. U.S. patent application Ser. No. 16/028,686 is incorporated herein by reference in its entirety.

TECHNICAL FIELD

Embodiments of the present invention relate generally to exercise equipment. More particularly, embodiments of the invention relate to a fitness bar with motion internal weights.

BACKGROUND

Individuals with problem areas such as a weak core, poor balance, lack of flexibility and muscle tone can benefit from regular exercise. In particular, such individuals can strengthen their core and improve balance, flexibility and muscle tone through weight training.

Exercise equipment varies greatly in shape, size, complexity and purpose. For example, dumbbells, kettlebells and barbells have been used for years by people to build strength and muscle. Various numbers of exercises can also be used in connection with even the simple piece of equipment like a jump rope or dumbbell.

It has also been appreciated that dynamic workouts that train the body through a full range of motion can benefit from a simple weighted. More beneficially, however, the bar can have moving parts in it, which may further activate and engage muscles to accommodate for the moving parts. For example, the moving parts cause shifts in weight that the user will have to expend energy in order to maintain a grip on the bar or maintain balance.

It is contemplated, however, that moving weights, if too aggressive, can cause damage to the body due to sudden jerking or impact. Therefore, it may be beneficial to have a bar with moving weights but where the movements of the weights are controlled (e.g., not shifting too abruptly from one end to another), to minimize impact and physical harm.

SUMMARY

A fitness/fitness bar can be handheld and used in gyms, homes, yoga studios, parks, and other spaces. The bar can be used with custom exercises or be incorporated into existing stretches, exercises or yoga. The fitness bar can be a tubular fitness bar that contains weighted movable parts that shift from one end to another. While performing functional exercises the shifting of the weight creates a smooth and safe resistance to improve muscle tone and overall physical condition.

According to some embodiments, a fitness bar includes a tube-shaped body; a plurality of weights; and a flow impeder, where the flow impeder and the plurality of weights are housed within a cavity of the tube-shaped body, and the flow impeder is configured to slow a migration of the plurality of weights between a first end and a second end of the tube-shaped body.

In one aspect, the flow impeder comprises a first funnel and a second funnel, each having a wide mouth and a narrow stem, joined together at the respective narrow stems.

In another aspect, the plurality of weights includes metal pellets.

BRIEF DESCRIPTION OF THE DRAWINGS

Embodiments of the invention are illustrated by way of example and not limitation in the figures of the accompanying drawings in which like references indicate similar elements.

DESCRIPTION OF EXAMPLES OF EMBODIMENTS

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

Body Shape and Dimensions

Figure 1A:
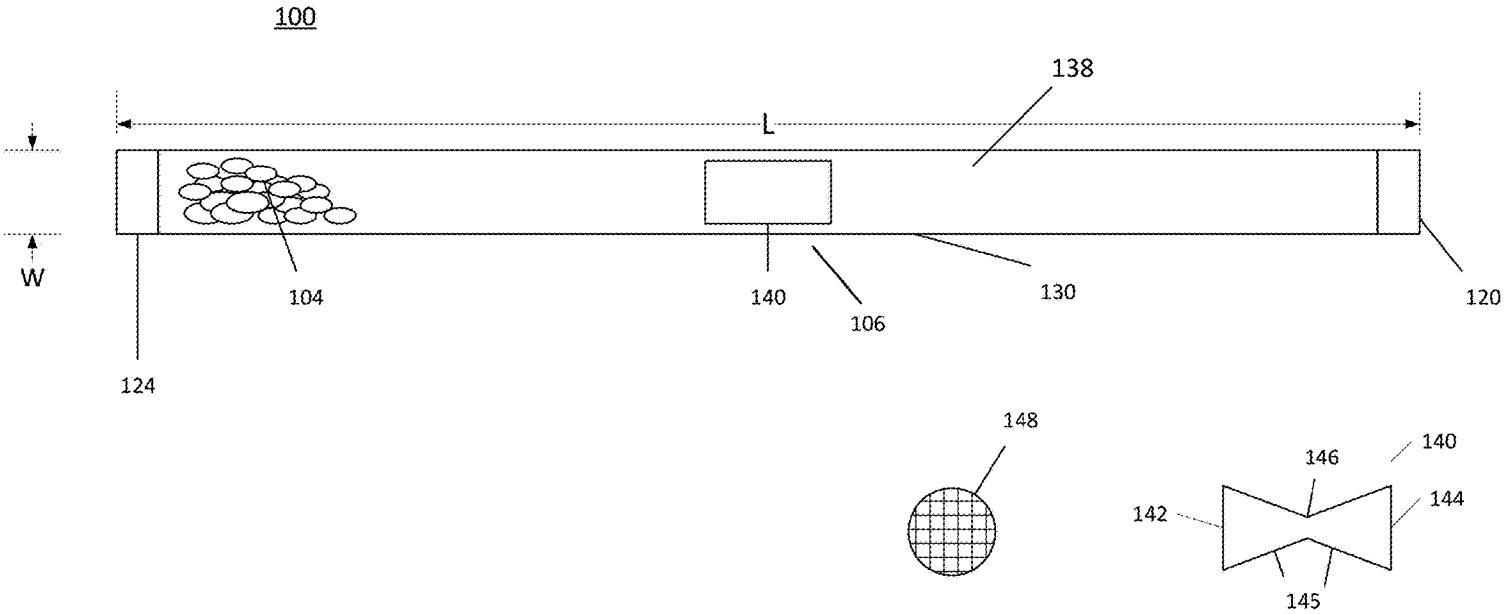
FIGS. 1A and 1B show the fitness bar according one embodiment.

FIG. 1A is an illustration of a fitness bar 100 according to one embodiment of the invention. As shown, a fitness bar can include a tube-shaped body 130 having a hollow cavity.

The fitness bar can have a length L and a width W. In the case that the fitness bar has circular cross-section, the width W is a diameter W. The length L can vary. For example, in a one embodiment, L can be 46" and W can be 1¾". In a larger embodiment, L can be 50" and W can be 2". In another embodiment, the width W can be from 1" to 2¼". The fitness bar can have different dimensions based on the size of a target user, the type of exercise that the bar is used for, the size of a user's handgrip, and other factors.

The fitness bar can have one or more removable caps (120 and 124) located at the first end and/or the second end. The caps can be screw connected to the tube-shaped body, snapped into place, or other equivalent method of providing a removable cap.

Figure 1B:
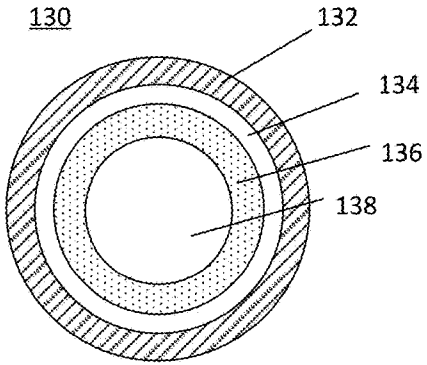

The fitness bar can have a cross-sectional profile that is circular, as shown in FIG. 1B. Alternatively, the cross-sectional profile can be square, rectangular, or polygonal with 5 or more sides.

Weights

A plurality of weights 104 can be housed in the cavity 138 of the tube-shaped body. The plurality of weights can advantageously be free-roaming weights (e.g. unfastened and capable of moving unrestricted within the cavity of the fitness bar, from one end of the body to the other), thus challenging a user to expend physical effort to stabilize the bar.

The plurality of weights 104 can, for example, be metal pellets. Advantageously, metal pellets can be sized small, for example, between 1 mm-10 mm or 2 mm-8 mm or 3 mm-5 mm, allowing for a smooth migration of weight from one end of the bar to another while minimizing impact. Furthermore, the metal pellets can have a spherical shape, thereby allowing them to roll freely throughout the fitness bar with minimal tumbling.

Alternatively or additionally, the plurality of weights 104 can include rocks, sand, or other equivalent material.

The movement and collisions of the weights can create a soothing sound, similar to a rain stick.

Flow Impeder

A flow impeder 106 can be housed in the cavity of the tube-shaped body 130, configured to slow a migration of the plurality of weights between a first end and a second end of the tube-shaped body. The flow impeder 106 can be a means to slow down and regulate the flow of the weights from one end of the fitness bar to the other end.

The flow impeder can include a two-sided funnel member 140, having a first wide mouth 142 and a second wide mouth 144 at an opposite side, joined together at a narrow midpoint 146, by tapering sections 145 like the interior of an hourglass. The geometry of the flow impeder (e.g., the size of the mouths and the midpoint of the funnel member, or the size of the openings in the screens) can be determined through routine experimentation to accommodate different flow rates of the weights (for example, a slow flow rate or a fast flow rate).

Additionally or alternatively, the flow impeder can include one or more screens 148 having openings sized to slow the flow of the plurality of weights.

The flow impeder 106 can be fixed at a middle point along the tube-shaped body. For example, the flow impeder can be fixed at a point equidistant from the first and second end of the fitness bar, thereby making the bar symmetrical in feel. Alternatively, the flow impeder can be asymmetrical, to accommodate a range of exercises and movements.

In this manner, the weights can move about freely in the fitness bar but controlled (e.g., slowed down) by the flow impeder to reduce harmful impacts and stress on a user's body due to drastic movements in the weights.

The flow impeder can be fixed to the tube-shaped body by one or more fastening members, for example, screws, nails, brackets, collars, or other equivalent structural members. Additionally or alternatively, the flow impeder can be fixed to the tube-shaped body by an adhesive. The flow impeder can also be formed with the tube-shaped body as a monolithic member (e.g., formed as a single part without breaks or seams).

Insulation and Grip

When the weights move about within the tube, this can create undesirable acoustic noise, beyond a pleasant loudness level. To reduce the noise, the fitness bar can include an insulation layer 136 housed on an interior wall of a stiff structural pipe member 134. The insulation layer can be a sound-dampening foam, rubber, plastic, or other suitable sound insulating material. Additionally or alternatively, the weights can have a sound-reducing structure. For example, the weights can have a soft exterior layer or coating such as plastic or rubber (e.g., artificial elastomer, latex, or other rubber material) such that when the weights move about the coating reduces the acoustic noise caused from collisions. The insulating layers can also reduce or mitigate the wear caused by the constantly moving weights on each other and on the inner wall of the housing.

The fitness bar can also include a grip layer 132 that covers the exterior surface of the stiff pipe member 134. The grip layer can comprise any suitable material that improves grip, for example, rubber, plastic, wood, metal, or mixtures thereof.

Figure 2A:
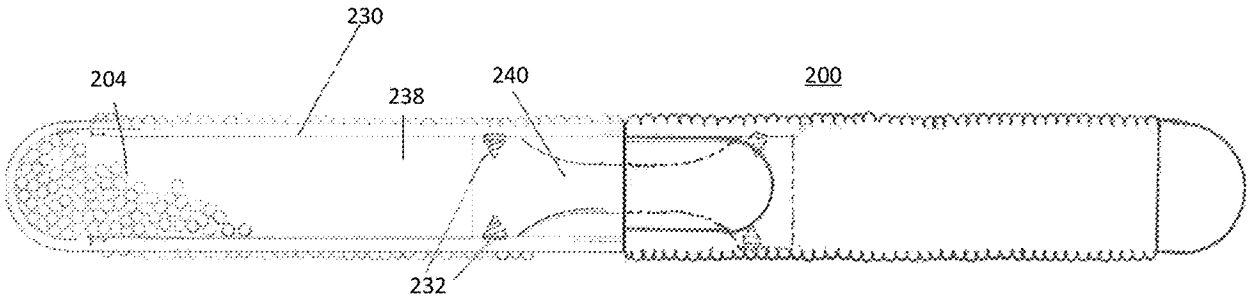
FIGS. 2A and 2B show the fitness bar according another embodiment.
Figure 2A:
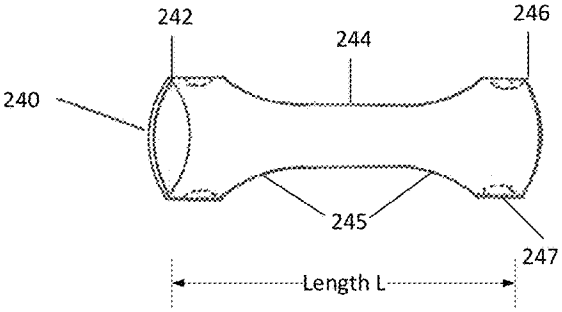

Referring now to FIG. 2A, in one embodiment, a fitness bar 200 can have 4.5 mm pellets 204 housed in a tube-shaped cylindrical body 230. Housed in the cavity 238 of the body is a flow impeder 240. The flow impeder can be a tube/tunnel that has a first opening 242 that leads to a narrower mid-section 244 that leads to a second opening 246 that is wider than mid-section 244. The first opening and the second opening can have equally sized openings, and tapering sections 245 that connect the openings to the midsection 244. The flow impeder can have a length L, for example, from 7" to 8" long. The flow impeder can have mount points 247, for example, openings. Screws, nails, or other fasteners 232 can then fix the flow impeder to the body 230 (for example, by penetrating the openings 247) so that the flow impeder is held in place within the cavity.

Figure 2B:
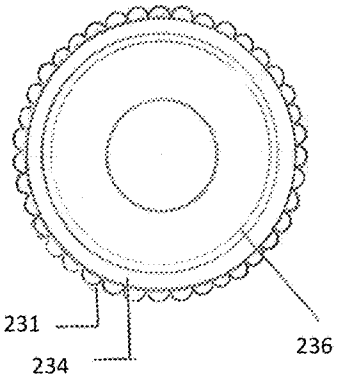

Referring now to FIG. 2B, in one embodiment, the body 230 can include a sound insulation layer 236, (for example, a rubber tube layer ⅛"-1/16" thick), a stiff pipe layer 234 (for example, ⅛" thick), and a grip layer 231 (for example, ⅛"-1/16" thick). The grip layer can be ribbed or textured to improve holding and comfort by being soft while being held by hands.

Holder/Rack

Figure 3B:
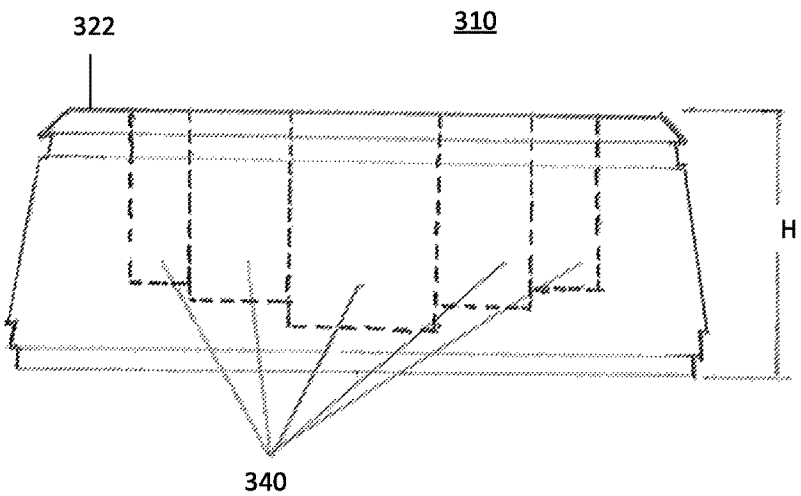
FIGS. 3A and 3B shows a fitness bar holder according to one embodiment.
Figure 3A:
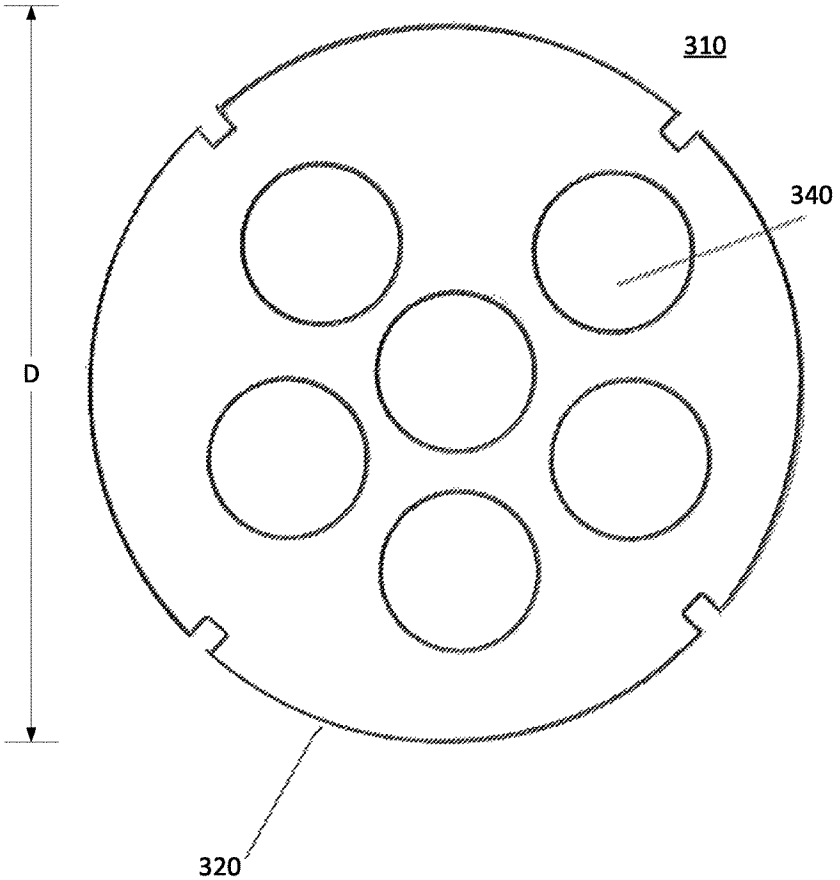

Referring now to FIGS. 3A and 3B, a base for holding one or more fitness bars is shown. The base 310 can have a disk shaped body 320 with a diameter D and a height H, and grooves that extend into the disk-shaped body forming cups 340 in the body. The grooves can be, for example, normal to the top surface 322 of the body. The grooves/cups can be sized to hold the one or more fitness bars (e.g. each groove can have a shape and opening sized to fit the cross-sectional profile of the one or more fitness bars). The grooves can be color coded, where each color can correspond to a fitness bar with a particular weight (unique to the fitness bars) and or length and width. The base 310 can have weights built into or connected to the body, for example, sand, beads, pellets or heavy plates, to prevent tipping over when housing the one or more fitness bars. In one embodiment, the diameter is from 50" to 54" and the height is from 11" to 13". The exact weight, diameter and height of the body, however, can be determined by routine experimentation by one skilled in the art.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A fitness bar comprising:

a tube-shaped body;

a plurality of weights; and a flow impeder, wherein:

the flow impeder and the plurality of weights are housed within a cavity of the tube-shaped body;

the flow impeder is configured to slow a migration of the plurality of weights between a first end and a second end of the tube-shaped body;

the flow impeder comprises a respective tapering section that gradually narrows to a midsection of the flow impeder from a respective opening at each end of the flow impeder;

the midsection of the flow impeder is narrower than the respective opening at each end of the flow impeder;

the flow impeder is fixed at a point within the tube-shaped body by at least one of one or more fastening members or an adhesive;

the plurality of weights are not fixed and can move about within the tube-shaped body; and at least one of:

one or more of the plurality of weights is covered with a sound insulating coating; or an insulation layer is housed in an interior of the tube-shaped body.

2. The fitness bar according to claim 1, wherein the plurality of weights comprise metal pellets.

3. The fitness bar according to claim 2, wherein the metal pellets have a spherical shape.

4. The fitness bar according to claim 3, wherein the metal pellets have a diameter between 3 mm and 5 mm.

5. The fitness bar according to claim 1, wherein the respective tapering section that gradually narrows to the midsection of the flow impeder from the respective opening at each end of the flow impeder is funnel-shaped.

6. The fitness bar according to claim 1, wherein the flow impeder forms an hourglass shape.

7. The fitness bar according to claim 1, wherein the midsection of the flow impeder is narrower than the tube-shaped body adjacent to the flow impeder.

8. The fitness bar according to claim 1, wherein the flow impeder comprises one or more screens having openings sized to slow the flow of the plurality of weights.

9. The fitness bar according to claim 1, wherein the fitness bar has a length of 45 inches to 52 inches.

10. The fitness bar according to claim 1, wherein the fitness bar has a diameter of 1.25 inches to 2.5 inches.

11. The fitness bar according to claim 1, wherein the flow impeder is fixed at a middle point along the tube-shaped body, equidistant from the first and second end.

12. The fitness bar according to claim 1, wherein the one or more of the plurality of weights is covered with the sound insulating coating.

13. The fitness bar according to claim 1, wherein the sound insulating coating comprises an artificial elastomer or latex.

14. The fitness bar according to claim 1, wherein the tube-shaped body has a circular cross-section.

15. The fitness bar according to claim 1, wherein the tube-shaped body has a cross sectional profile that is rectangular, square, or a polygon with 5 or more sides.

16. The fitness bar according to claim 1, wherein the insulation layer is housed in the interior of the tube-shaped body.

17. The fitness bar according to claim 1, wherein the insulation layer comprises sound-dampening foam.

18. The fitness bar according to claim 1, wherein the tube-shaped body comprises a respective cap at each of the first end and the second end.

19. The fitness bar according to claim 1, wherein a respective cap at each of the first end and the second end is removable.

20. The fitness bar according to claim 1, further comprising a grip layer located at an outer surface of the tube-shaped body.

* * * * *